US005143098A

United States Patent [19]

Rogers et al.

[11] Patent Number: 5,143,098

[45] Date of Patent: Sep. 1, 1992

[54] MULTIPLE LAYER CIGARETTE PAPER FOR REDUCING SIDESTREAM SMOKE

[75] Inventors: Robert M. Rogers, Richmond; Gordon H. Bokelman, Chesterfield; Sheryl D. Baldwin, Richmond; Susan S. Tafur, Midlothian, all of Va.

[73] Assignee: Philip Morris Incorporated, New York, N.Y.

[21] Appl. No.: 365,137

[22] Filed: Jun. 12, 1989

[51] Int. Cl.[5] ..... A24D 1/02

[52] U.S. Cl. ..... 131/365; 162/125; 162/139

[58] Field of Search ..... 131/365, 358; 162/123, 162/125, 128, 139

[56] References Cited

U.S. PATENT DOCUMENTS

| | | | |
|---|---|---|---|
| 347,906 | 8/1886 | White . | |
| 865,012 | 9/1907 | Butler | 131/353 |
| 2,673,565 | 3/1954 | Shur et al. . | |
| 2,754,207 | 7/1956 | Shur et al. . | |
| 3,633,589 | 1/1972 | Kahane et al. . | |
| 3,744,496 | 7/1973 | McCarty et al. . | |
| 4,108,151 | 8/1978 | Martin et al. . | |
| 4,225,636 | 9/1980 | Cline et al. . | |
| 4,231,377 | 11/1983 | Cline et al. . | |
| 4,407,308 | 10/1983 | Baker et al. . | |
| 4,420,002 | 12/1983 | Cline . | |
| 4,433,697 | 2/1984 | Cline et al. . | |
| 4,459,998 | 7/1984 | Labbe et al. . | |
| 4,461,311 | 7/1984 | Mathews et al. . | |
| 4,505,282 | 3/1985 | Cogbill et al. . | |
| 4,561,454 | 12/1985 | Guess . | |
| 4,574,821 | 3/1986 | Fischer et al. . | |
| 4,585,016 | 4/1986 | Grollimund . | |
| 4,607,647 | 8/1986 | Dashley et al. . | |
| 4,615,345 | 10/1986 | Durocher . | |
| 4,624,268 | 11/1986 | Baker et al. . | |
| 4,691,717 | 9/1987 | Ikeda et al. . | |
| 4,721,120 | 1/1988 | Greig et al. . | |
| 4,779,631 | 10/1988 | Durocher et al. . | |
| 4,805,644 | 2/1989 | Hampl, Jr. et al. . | |

FOREIGN PATENT DOCUMENTS

| | | |
|---|---|---|
| 0085494 | 8/1983 | European Pat. Off. . |
| 0133575 | 2/1985 | European Pat. Off. . |
| 0251254 | 1/1988 | European Pat. Off. . |
| 2094130A | 9/1982 | United Kingdom . |

*Primary Examiner*—V. Millin
*Attorney, Agent, or Firm*—Loretta A. Miraglia

[57] ABSTRACT

The sidestream smoke associated with a cigarette or cigarette-like smoking article is reduced by wrapping the tobacco in a single sheet of paper having multiple layers.

16 Claims, No Drawings

MULTIPLE LAYER CIGARETTE PAPER FOR REDUCING SIDESTREAM SMOKE

BACKGROUND OF THE INVENTION

The present invention relates to a wrapper construction for use in conjunction with a smoking article, such as a cigarette, that results in the production of reduced amounts of sidestream smoke. More particularly, this invention relates to a paper wrapper for a cigarette formed as a single sheet but having two or more layers.

With marked changes in the public's attitude and tolerance toward cigarette smoking in recent years, there has been an increased hostility by non-smokers toward smokers. This increased hostility occurs primarily in public places where non-smokers may be exposed to the smoke generated from the cigarettes of smokers. This smoke is generated when the smoker puffs on the cigarette and also when the cigarette is idling between puffs. The smoke generated when the cigarette is idling is known as sidestream smoke. This sidestream smoke contributes nothing to the smoker's enjoyment and contributes greatly to the discomfort of non-smokers who may be located nearby. Thus attempts have been made to reduce the sidestream smoke generated by cigarettes. These attempts have generally been directed to supplying certain additives to the cigarette paper or wrapping the cigarette with two separate sheets of wrapping paper. None of these attempts has been entirely satisfactory. In addition, in the production of cigarettes having multiple wrappings of paper there is the added problem and expense of wrapping a number of different sheets of paper around the cigarette.

It would be desirable to provide a wrapper for a smoking article that results in the production of a reduced amount of sidestream smoke.

It would also be desirable to provide a wrapper comprised of a single sheet of paper for a smoking article that results in the production of a reduced amount of sidestream smoke.

It would still further be desirable to provide a multiple layer sheet of paper that may be economically used as a cigarette wrapper wherein said multilayer sheet is a sheet having two or more distinct zones overlying each other.

SUMMARY OF THE INVENTION

It is therefore an object of this invention to provide a wrapper for a smoking article that results in a reduced amount of sidestream smoke.

It is another object of this invention to provide a wrapper comprised of a single sheet of paper for a smoking article that results in the production of a reduced amount of sidestream smoke.

It is still a further object of this invention to provide a multiple layer sheet of paper that may be economically used as a cigarette wrapper.

In accordance with the invention, there is provided a paper wrapper for a smoking article, such as a cigarette, that results in the production of a reduced amount of sidestream smoke. The paper wrapper of this invention is multilayer but is formed as a single sheet. Preferably two layers are employed. The outer layer preferably has a basis weight of about 30 to about 60, more preferably about 45, grams per square meter. This outer layer is preferably filled with a calcium carbonate loading of about 30 to about 40, more preferably about 35, percent by weight with the calcium carbonate preferably having a surface area of about 10 to about 80, more preferably about 20 to about 25, square meters per gram as measured by the BET method.

The inner layer preferably about 15 to about 25, and most preferably has a basis weight of about 10 to about 40, more preferably about 18, grams per square meter. This inner layer preferably is filled with a calcium carbonate loading of about 2 to about 15, more preferably about 3, percent by weight with the calcium carbonate having a surface area of about 7 to about 10 square meters per gram.

The resulting bilayer sheet has a basis weight of about 40 to about 100, preferably about 63, grams per square meter and a porosity of about 5 to about 20, preferably about 5, cubic centimeters per minute as determined by the Coresta method. The resulting bilayer sheet may be perforated to about 20 to about 60 Coresta to improve its burning characteristics.

A burn chemical additive such as succinate, citrate, or any other alkali metal burn chemical known to those in the industry may be added to the wrapper in an amount equal to about 2 to about 10, preferably about 4.5, percent by weight. In addition, about 0 to about 1, preferably about 0.5 percent by weight of monoammonium phosphate, and about 0 to about 1, preferably about 0.4 percent by weight of sodium carboxy methyl cellulose may also be added to the wrapper.

Further features of the invention, its nature and various advantages will be more apparent from the following detailed description of the preferred embodiments.

DETAILED DESCRIPTION OF THE INVENTION

Although reference will be made to a bilayer cigarette paper, it will be understood that this invention contemplates triple or a higher multiple layer single sheet cigarette paper. These higher multiple layer single sheets can be made by adding additional headboxes to a single wire paper making machine or combining the individual layers from each wire of a multiple wire paper making machine.

The multiple layer single sheet paper wrapper of this invention may be made using ordinary paper furnish such as pulped wood, flax fibers, or any standard cellulosic fiber. Preferably flax fibers are used. Different fillers or different fibers may be used for each layer and may be contained in different headboxes.

In a single wire machine, the location of the headboxes is an important factor in achieving a single sheet of a multiple layer paper that is suitable for use as a wrapper for a cigarette. The first headbox is generally located in the standard position. Preferably the second headbox is located at a position past the vacuum foils. This permits adequate drainage of the white water from the first layer and allows the first layer to consolidate before adding the furnish from the second headbox on to the first layer.

The furnish from the first headbox is ejected onto the wire as in a standard Fourdrinier paper making machine. The furnish from the second headbox is ejected onto the top of the original, partially drained furnish that was ejected on to the wire from the first headbox.

A multiple wire paper making machine may also be used with this type of a machine, the different layers can be combined after each layer has consolidated to the point where each layer is about 4% to about 5% solids.

It has been surprisingly found that when a single sheet of multilayer paper is used as a wrapper for a cigarette, sidestream smoke production is substantially reduced. The cigarette with which the multilayer wrapper is used may be of any length and circumference. For example, the circumference of the cigarette may be in the range from about 15 to about 25 millimeters, although the invention tends to produce greater reductions in sidestream smoke for cigarettes near the lower end of that circumference range.

In a bilayer system, the outer layer, which is the layer that is furthest away from the tobacco of the cigarette, preferably has a basis weight of about 30 to about 60, preferably about 45, grams per square meter. The outer layer is preferably filled with a calcium carbonate loading of about 30 to about 40, more preferably about 35, per cent by weight. The calcium carbonate used preferably should be about 0.01 to about 0.2 microns in size and more preferably about 0.07 microns in size. This translates into a surface area of preferably about 10 to about 80, more preferably about 20 to about 25, square meters per gram as measured by the BET method. This is a relatively high surface area for a filler in a cigarette paper. A typical surface area would be about 7 to about 10 square meters per gram. Although calcium carbonate is the preferred filler, other standard fillers such as magnesium carbonate could also be used.

The inner layer, which is the layer that is closest to the tobacco of the cigarette, preferably has a basis weight of about 10 to about 40, more preferably about 15 to about 25, and most preferably about 18, grams per square meter. The inner layer is preferably filled with a calcium carbonate loading of about 2 to about 15, more preferably about 3, percent by weight. This relatively low calcium carbonate loading helps to slow down the burn rate of the paper and contributes to the reduction in the sidestream smoke generation. The calcium carbonate preferably has a surface area of about 7 to about 10 square meters per gram. Again, other standard fillers such as magnesium carbonate could be used.

The single sheet of paper resulting from this combination of inner and outer layers preferably has a basis weight of about 40 to about 100 and more preferably about 63 grams per square meter. This single sheet also preferably has a porosity of about 5 to about 20, preferably about 5, cubic centimeters of air per minute as determined by the well-known Coresta method. Preferably this resulting bilayer, single sheet is perforated to about 20 to about 60 Coresta. This is done to improve the subjective characteristics of the paper.

To help control or determine the puff count of the cigarette, the resulting bilayer sheet preferably includes about 2 to about 10 percent by weight of a burn chemical such as succinate, citrate, or any other alkali metal burn chemical known to those in the industry. More preferably about 4.5 percent by weight potassium succinate is used.

If calcium carbonate is used as the filler, this burn chemical is believed to act as a fluxing or dispersing agent for the calcium carbonate. It is also believed to combine with the calcium carbonate to help make a relatively air- and smoke-impervious ash. The imperviousness of the ash, which is also promoted by the high surface area of the calcium carbonate is believed to contribute significantly to the reduction of sidestream smoke.

The bilayer sheet may also preferably include about 0 to about 1, more preferably about 0.5, percent by weight monoammonium phosphate. This chemical tends to reduce unattractive streaking of the outer layer due to condensation on the inside of the paper following puffs. The tendency of the paper to streak in this manner is increased because the porosity of the paper has been reduced to cut down on sidestream smoke. Monoammonium phosphate may be used to eliminate this possible cosmetic problem.

Another additive that may be used in the bilayer sheet is sodium carboxy methyl cellulose. Preferably about 0 to about 1, more preferably about 0.4, percent by weight sodium carboxy methyl cellulose is used. This chemical, which acts as a film former, contributes to the imperviousness of the ash, which, as has been mentioned, helps to reduce sidestream smoke. Sodium carboxy methyl cellulose is also believed to act as a carrying agent to help get the burning agent, e.g., succinate, into the paper.

These or other water soluble additives that may be used in the multi-layer paper are preferably added to the multi-layer paper at the size press for even penetration through each layer.

It has been found that a cigarette having a 17 millimeter circumference and made with paper having the properties described above as preferred produces about 40% less sidestream smoke than a similarly sized, but otherwise conventional, cigarette. The sidestream smoke reduction is about 70% when compared to a conventional cigarette about 25 millimeters in circumference.

Thus it can be seen that a multiple layer single sheet of paper is provided that may be economically used as a wrapper for a smoking article and that substantially reduces sidestream smoke. One skilled in the art will appreciate that the invention can be practiced by other than the described embodiments, which are presented for purposes of illustration and not of limitation, and the present invention is limited only by the claims which follow.

What is claimed is:

1. A wrapper for a smoking article for reducing sidestream smoke comprising a single cellulosic sheet having two or more distinct zones overlying each other in such an arrangement so as to reduce sidestream smoke formed from multiple layers of cellulosic sheet material during the paper making process.

2. The wrapper of claim 1 wherein said cellulosic sheet has a basis weight of about 40 to about 100 grams per square meter and a porosity of about 5 to about 20 cubic centimeters of air per minute as determined by the well-known Coresta method.

3. The wrapper of either of claims 1 or 2 wherein said cellulosic sheet is perforated to about 20 to about 60 cubic centimeters of air per minute as determined by the well-known Coresta method.

4. A bilayer single sheet wrapper for a smoking article formed from an inner layer and an outer layer wherein said outer layer has a basis weight of about 30 to about 60 grams per square meter, a filler loading of about 30 to about 40 percent by weight employing filler having a surface area of about 10 to about 80 square meters per gram by the BET method, and said inner layer has a basis weight of about 10 to about 40 grams per square meter, a filler loading of about 2 to about 15 percent by weight employing filler having a surface area of about 7 to about 10 square meters per gram.

5. The wrapper of claim 4 having a basis weight of about 40 to about 100 grams per square meter and a porosity of about 5 to about 20 cubic centimeters of air per minute as determined by the well-known Coresta method.

6. The wrapper of either of claims 4 or 5 further comprising about 2 to about 10 percent by weight of a burn chemical.

7. The wrapper of claim 6 further comprising about 0 to about 1 percent by weight monoammonium phosphate.

8. The wrapper of claim 7 further comprising about 0 to about 1 percent by weight sodium carboxy methyl cellulose.

9. The wrapper of claim 6 wherein said burn chemical is an alkali metal burn chemical.

10. The wrapper of claim 5 wherein said wrapper is perforated to about 20 to about 60 cubic centimeters of air per minute as determined by the well-known Coresta method.

11. The wrapper of claim 9 wherein said alkali metal burn chemical is a succinate salt of the alkali metal.

12. The wrapper of claim 9 wherein said alkali metal burn chemical is a citrate salt of the alkali.

13. The wrapper of claim 4 wherein said outer layer has a basis weight of about 45 grams per square meter, a filler loading of about 35 percent by weight employing filler having a surface area of about 20 to about 25 square meters per gram by the BET method, and said inner layer has a basis weight of about 15 to about 25 grams per square meter and a filler loading of about 3 percent by weight.

14. The wrapper of claim 13 wherein said inner wrapper has a basis weight of about 18 grams per square meter.

15. The wrapper of claim 5 having a basis weight of about 63 grams per square meter and a porosity of about 5 cubic centimeters of air per minute as determined by the well-known Coresta method.

16. The wrapper of either of claims 4, 5, 13, 14 or 15 comprising 4.5 percent by weight potassium succinate.

* * * * *